US007455398B2

(12) United States Patent
Kanbe

(10) Patent No.: US 7,455,398 B2
(45) Date of Patent: Nov. 25, 2008

(54) INK CARTRIDGE

(75) Inventor: Tomohiro Kanbe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 309 days.

(21) Appl. No.: 11/291,914

(22) Filed: Dec. 2, 2005

(65) Prior Publication Data

US 2006/0125888 A1 Jun. 15, 2006

(30) Foreign Application Priority Data

Dec. 13, 2004 (JP) ..... 2004-359730
Dec. 13, 2004 (JP) ..... 2004-359742

(51) Int. Cl.
*B41J 2/175* (2006.01)

(52) U.S. Cl. ..... 347/86

(58) Field of Classification Search ..... 347/84, 347/86, 87; 137/222; 251/149.1, 149.6, 251/318, 323
See application file for complete search history.

(56) References Cited

U.S. PATENT DOCUMENTS

| | | | | |
|---|---|---|---|---|
| 5,949,456 | A | 9/1999 | Matsumoto et al. | |
| 6,745,998 | B2 * | 6/2004 | Doyle | 251/149.6 |
| 6,786,581 | B1 | 9/2004 | Shinada et al. | |
| 7,033,007 | B2 * | 4/2006 | Seethoo | 347/85 |
| 2001/0048456 | A1 | 12/2001 | Higuma | |
| 2004/0233258 | A1 | 11/2004 | Kitabataki et al. | |
| 2005/0140749 | A1 | 6/2005 | Usui et al. | |

FOREIGN PATENT DOCUMENTS

| | | |
|---|---|---|
| EP | 0 794 058 A2 | 9/1997 |
| EP | 1 147 903 A1 | 10/2001 |
| EP | 1 336 496 A2 | 8/2003 |
| EP | 1 479 521 A1 | 11/2004 |
| EP | 1 541 359 A1 | 6/2005 |
| JP | A 2001-113723 | 4/2001 |

* cited by examiner

*Primary Examiner*—Anh T. N. Vo
(74) *Attorney, Agent, or Firm*—Oliff & Berridge, PLC

(57) ABSTRACT

An ink cartridge including: an ink chamber storing ink; a communication chamber communicating the ink chamber with the exterior of the ink cartridge; a valve member disposed in the communication chamber such that the valve member is displaceable between a first position to shut off communication between the ink chamber and the exterior, and a second position to permit the communication; a biasing member including a side wall portion surrounding the valve member, and an engaging portion extending inward from an end of the side wall portion and engaging with the valve member, the biasing member normally holding the valve member at the first position but allowing the valve member to be placed at the second position by an elastic deformation of at least one of the side wall portion and the engaging portion, and generating a biasing force to restore the valve member to the first position; and a disengagement preventer which prevents the valve member from disengaging from the engaging portion when the valve member is abnormally operated toward the second position.

20 Claims, 9 Drawing Sheets

CROSS-SECTIONAL VIEW
TAKEN ALONG LINE A-A

INK CARTRIDGE

INCORPORATION BY REFERENCE

The present application is based on Japanese Patent Applications Nos. 2004-359730 and 2004-359742, both filed on Dec. 13, 2004, the contents of which are incorporated herein by reference.

BACKGROUND OF THE INVENTION

1. Field of the Invention

The invention relates to an ink cartridge for supplying ink to a recording apparatus.

2. Description of Related Art

JP-2001-113723 (especially FIG. 4) discloses an ink cartridge for supplying ink to a recording apparatus such as inkjet printer, which cartridge is constructed such that the ink does not leak upon removal of the cartridge from the recording apparatus. This ink cartridge has an ink chamber where the ink is stored, an ink outlet through which the ink is supplied to the exterior, and an ink communication chamber.

In the ink communication chamber is accommodated a valve member, and in the ink outlet is fitted a tubular packing. The valve member is biased by a compression spring and held in contact with the tubular packing so as to close an ink passage, thereby preventing leakage of the ink from the ink chamber. When the ink cartridge is attached to the recording apparatus, an ink inlet tube disposed on the recording apparatus enters the tubular packing to push the valve member to the side of the ink chamber against the biasing force of the compression spring, so as to open the ink passage and enables ink supply.

However, in the ink cartridge described above, the displacement of the valve member is realized by use of the compression spring, and thus an internal structure of the ink cartridge using the compression spring is complex. Further, the compression spring is of metal and the ink cartridge can not be discarded as it is. That is, upon disposal of a used ink cartridge, the compression spring should be detached from the ink cartridge to be discarded separately from the other part of the ink cartridge, thereby pushing up the cost of the disposal.

To solve the above-described problems, the present applicant has proposed to replace the compression spring with a biasing member formed of an elastic material to integrally include an elastic side wall portion that surrounds the valve member and is capable of deforming in a direction of the displacement of the valve member, and an engaging portion that extends inward from an end of the side wall portion to be in contact with a surface of the valve member which surface is opposite to a valve hole. An elastic, contracting force of the side wall portion biases the valve member to a position to close the ink passage or the valve hole.

The employment of the biasing member enables to omit the compression spring, thereby preventing the internal structure of the ink cartridge from being complex. Further, being formable of an elastic material such as rubber, the biasing member needs not to be detached from the ink cartridge upon disposal of the ink cartridge. Thus, the disposal cost is not increased.

When the ink cartridge including the biasing member is attached to the recording apparatus, the ink inlet tube disposed on the recording apparatus pushes the valve member as closing the ink passage to displace the valve member by stretching the side wall portion of the biasing member against the elastic biasing force thereof so as to open the ink passage.

Hence, a space for allowing expansion of the side wall portion of the biasing member should be provided.

However, a user may attach the ink cartridge to the recording apparatus in an improper manner or tamper with the ink cartridge, such that the valve member is pushed by an amount larger than a normal amount by which the valve member is expected to be pushed, or in a direction different from a normal direction in which the valve member is expected to be pushed. In the event of this, the side wall portion of the biasing member is stretched excessively, or the engaging portion is deformed into an irregular shape by locally deforming more at a part than the other part, resulting in disengagement of the valve member from the engaging portion of the biasing member, that is, the valve member gets out of the biasing member into the above-mentioned space and become incapable of getting back to a position to close the ink passage in a valve chamber defined inside the biasing member. This causes leakage of the ink from the ink cartridge and evaporation of water or other components from the ink.

SUMMARY OF THE INVENTION

This invention has been developed in view of the above-described situations and it is therefore an immediate object of the invention to provide an ink cartridge including a valve member which can maintain functioning even when the valve member is pushed by an amount larger than a normal amount or in a direction different from a normal direction, in order to prevent leakage of ink from the ink cartridge and evaporation of water and other components from the ink.

To attain the object, the invention provides an ink cartridge including:

an ink chamber storing ink;

a communication chamber communicating the ink chamber with the exterior of the ink cartridge;

a valve member disposed in the communication chamber such that the valve member is displaceable between a first position to shut off communication between the ink chamber and the exterior, and a second position to permit the communication;

a biasing member including a side wall portion surrounding the valve member, and an engaging portion extending inward from an end of the side wall portion and engaging with the valve member, the biasing member normally holding the valve member at the first position but allowing the valve member to be placed at the second position by an elastic deformation of at least one of the side wall portion and the engaging portion, and generating a biasing force to restore the valve member to the first position; and a disengagement preventer which prevents the valve member from disengaging from the engaging portion when the valve member is abnormally operated toward the second position.

According to this arrangement, when the ink cartridge is not mounted on a recording apparatus, the valve member is biased in a direction to be held in a first position where the valve member shuts off communication between the ink chamber and the exterior. When the ink cartridge is mounted on the recording apparatus, the valve member is displaced, while stretching the biasing member against a biasing force thereof, to a second position to establish communication between the ink chamber and the exterior.

Where the valve member is pushed by an amount larger than a predetermined, normal or expected amount upon mounting or attaching of the ink cartridge to the recording apparatus, or in a direction other than a normal, expected direction, the valve member tends to disengage from the engaging portion. According to this invention, however, such disengagement is prevented by the disengagement preventer. Thus, it does not occur that the valve member disengages from the engaging portion and becomes incapable of returning to the first position to shut off the communication between the ink chamber and the exterior, which would otherwise cause leakage of the ink from the ink cartridge or evaporation of water or other components from the ink.

An ink cartridge according to the invention is not limited to the above-described one that includes the biasing member integrally formed of an elastic material to include the side wall portion and the engaging portion, but the invention is also applicable to an ink cartridge including a biasing member having a structure more general. Further, the invention is applicable to not only a communication chamber on an ink supply side, i.e., an ink communication chamber formed to supply the ink in the ink chamber to the exterior therethrough, but also a communication chamber on an air introduction side, i.e., an air communication chamber formed in the ink cartridge to introduce the outside air into the inside of the ink cartridge therethrough.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Figure 1:
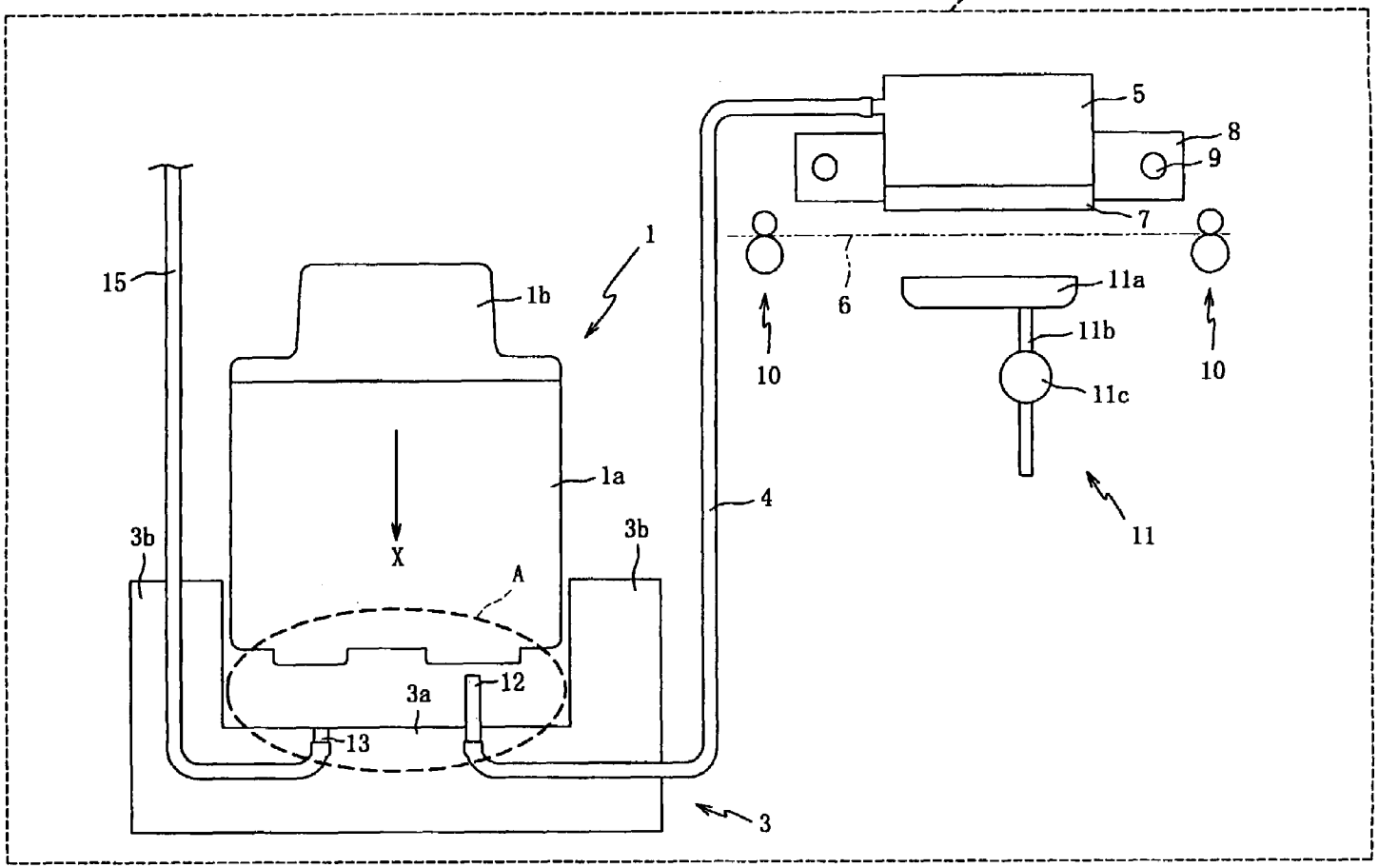
FIG. 1 is a schematic view of an inkjet recording apparatus to which an ink cartridge according to a first embodiment of the invention is attached.

Hereinafter, there will be described several presently preferred embodiments of the invention, by referring to the accompanying drawings.

Referring to FIGS. 1 to 7, there will be described an ink cartridge according to the first embodiment. In a schematic view of FIG. 1, reference numerals 1 and 2 denote the ink cartridge and an inkjet recording apparatus to which the cartridge is attached.

The ink cartridge 1 is removably attachable to the ink jet recording apparatus 2 including a printhead 7 for ejecting ink droplets, and stores ink to be supplied to the printhead 7.

The ink cartridge 1 includes a casing 1*a* which is a hollow box-like member open in its upper side, and a lid 1*b* closing the upper open side of the casing 1*a*. The ink to be supplied to the printhead 7 is stored in an ink chamber 16 (shown in FIG. 2) in the casing 1*a*. A plurality of the ink cartridges 1, each containing ink of one of four colors, namely, cyan, magenta, yellow, and black, are attached to the inkjet recording apparatus 2.

The inkjet recording apparatus 2 includes a mounting portion 3 at which each ink cartridge 1 is removably attached, a tank 5 which stores ink as supplied from the ink cartridge 1 via a flexible ink supply tube 4, the printhead 7 which ejects droplets of the ink stored in the tank 5 onto a recording sheet 6, a carriage on which the tank 5 and the printhead 7 are mounted and which is reciprocated in a horizontal direction, carriage shafts 9 serving as a guide along which the carriage 8 reciprocates, a feeding mechanism 10 for feeding the recording sheet 6, and a purging device 11.

The mounting portion 3 has a base portion 3*a* and two guide portions 3*b* standing upright from opposite ends of the base portion 3*a*. In the base portion 3*a* interposed between the guide portions 3*b*, there are disposed a hollow ink inlet tube 12 via which the ink stored in the ink cartridge 1 is drawn into the ink supply tube 4, and an air supply passage 13 through which air is supplied into the ink cartridge 1.

The ink supply tube 4 is connected to an end of the ink inlet tube 12 so that the ink inlet tube 12 is communicated with the tank 5 via the ink supply tube 4. One of opposite ends of an air supply tube 15 is connected to the air supply passage 13, and the other end of the air supply tube 15 is communicated with the atmosphere.

In a surface of the printhead 7 to be opposed to the recording sheet 6, a plurality of nozzles are arranged. Hereinafter, this surface will be referred to as "the nozzle surface". By driving an actuator constituted by a piezoelectric element, the ink stored in the tank 5 is ejected in the form of droplets through the nozzles toward the recording sheet 6. Recording or printing on the recording sheet 6 is performed while the carriage 8 on which the printhead 7 is mounted is being reciprocated.

The printhead 7 is located above the mounting portion 3 so that the ink inside the nozzles is applied with a negative back pressure due to a head difference between the nozzles and the ink cartridge 1 as attached at the mounting portion 3.

The purging device 11 is disposed to be opposed to the printhead 7 at a position outside a recording area, and includes a purge cap 11*a* to cover the nozzle surface of the printhead 7, a waste ink tube 11*b* in communication with the purge cap 11*a*, and the pump 11*c* which sucks the ink from the nozzles via the waste ink tube 11*b*.

When a purging operation is implemented, the carriage 8 is moved to a purging position, and the nozzle surface of the printhead 7 is covered by the purge cap 11*a*. In this state, the pump 11*c* is driven to suck bad ink containing bubbles and others and accumulated inside the printhead 7. The sucked bad ink is drawn via the waste ink tube 11*b* into a waste ink tank (not shown) to be stored therein. Recording and purging is controlled by a central processing unit or a CPU (not shown) in the inkjet recording apparatus 2.

Figure 2:
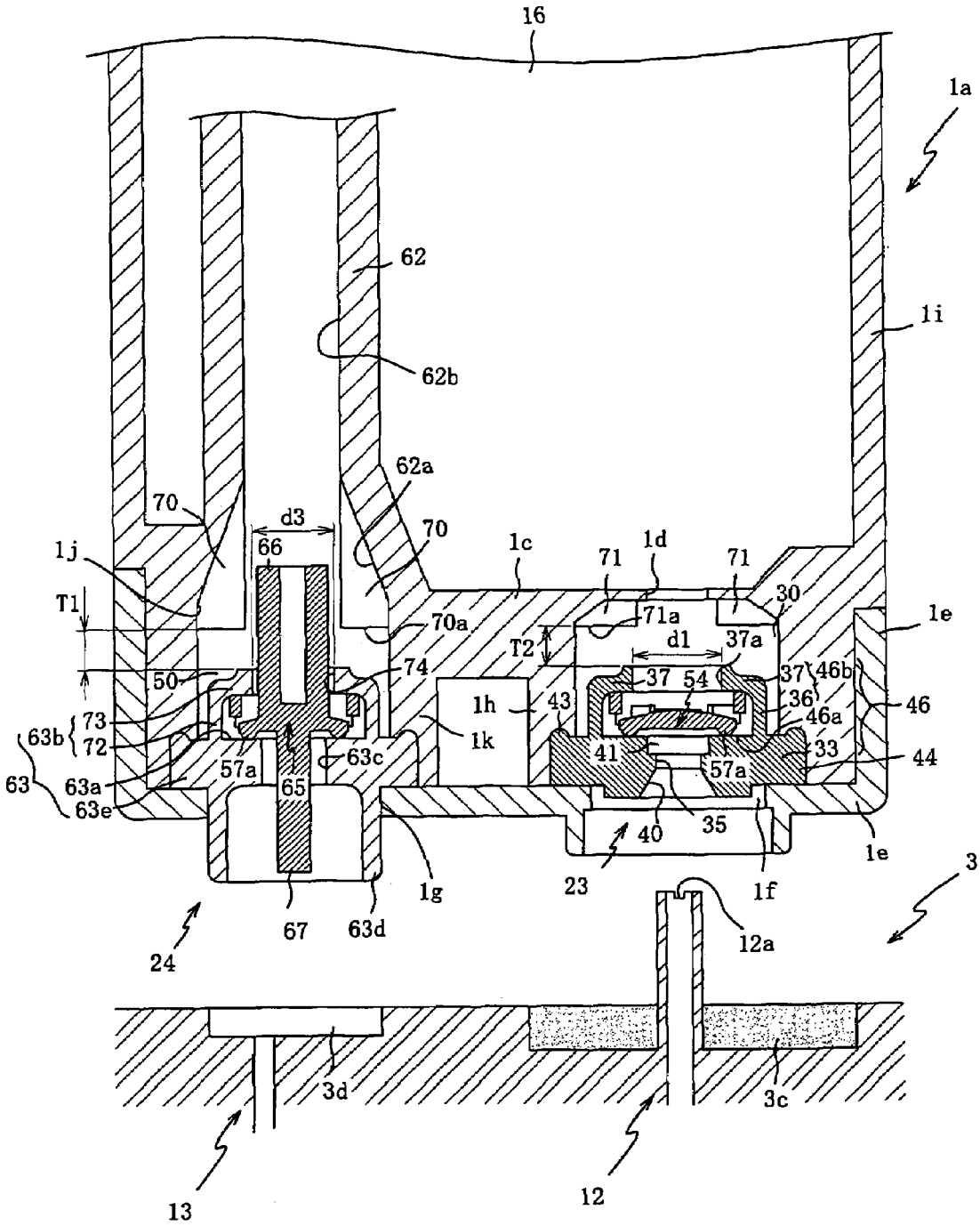
FIG. 2 is a cross-sectional view showing a state before the ink cartridge is attached to the inkjet recording apparatus.
Figure 3:
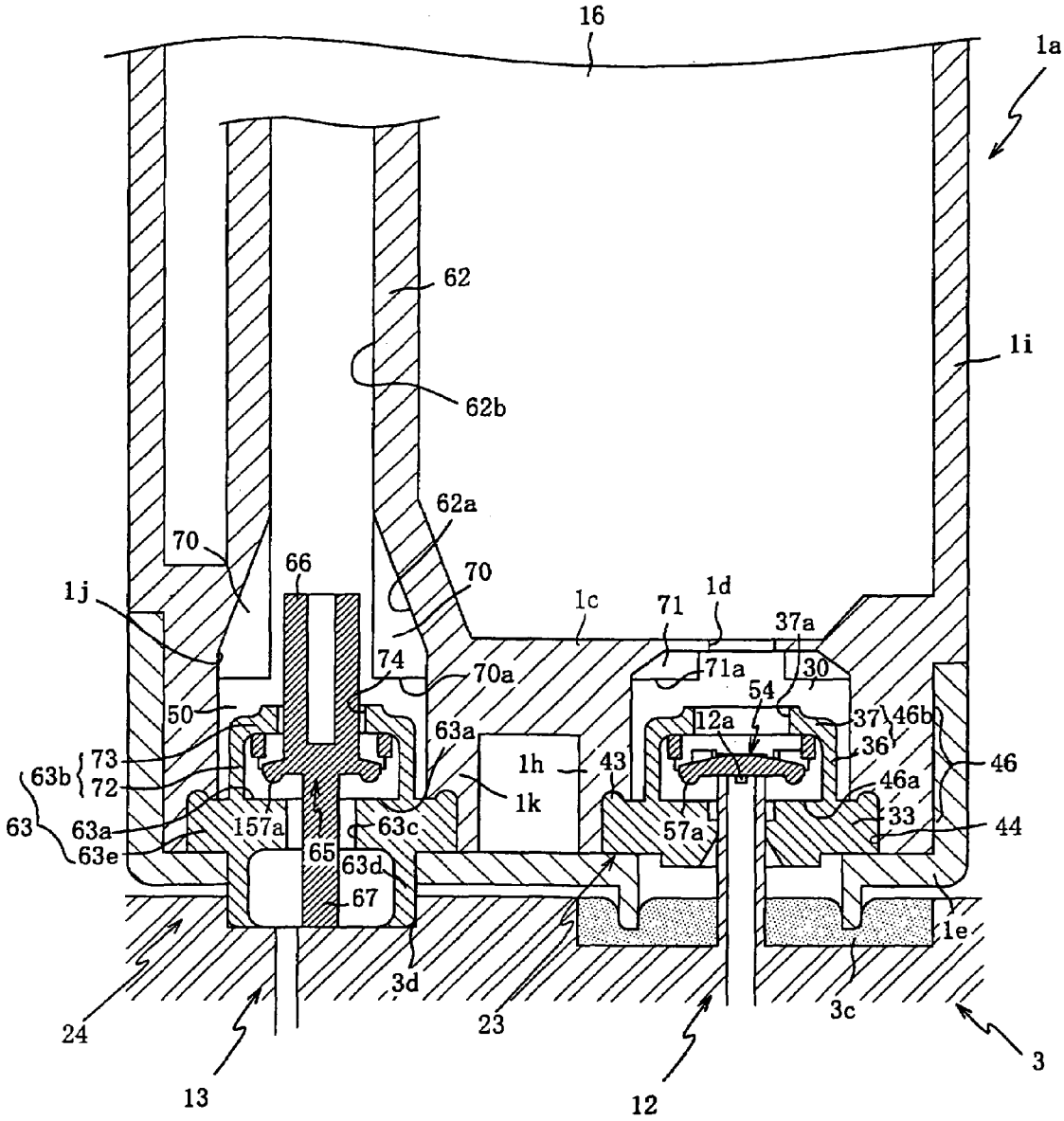
FIG. 3 is a cross-sectional view showing a state where the ink cartridge is attached to the inkjet recording apparatus.
Figure 4A:
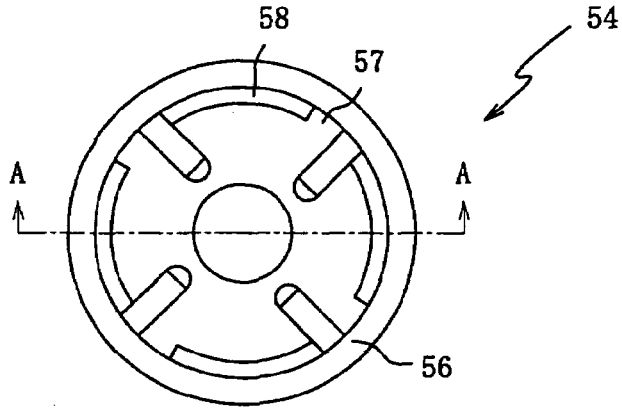
FIGS. 4A, 4B, 4C and 4D are respectively a plan view, a side view, a cross-sectional view taken along line A-A in FIG. 4A, and a bottom view, of a valve member in the ink cartridge.
Figure 4B:
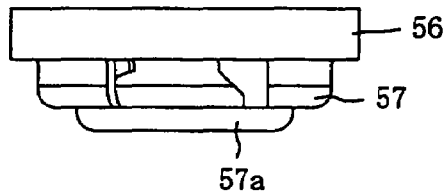
Figure 4C:
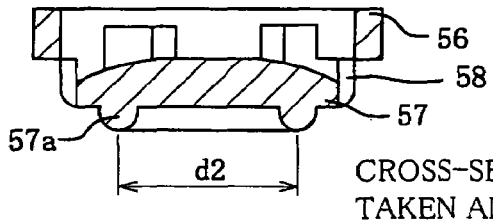
Figure 4D:
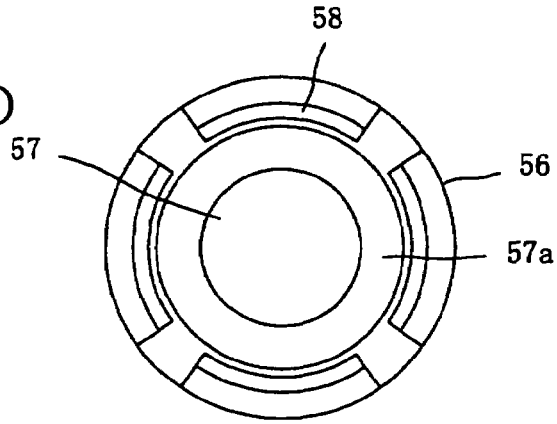

Referring now to cross-sectional views of FIGS. 2 and 3, there will be described a structure of a joint portion as indicated by reference symbol A in FIG. 1, at which the ink cartridge 1 is attached to the inkjet recording apparatus 2. FIG. 2 shows a state before the ink cartridge 1 is attached to the inkjet recording apparatus 2, and FIG. 3 shows a state in which the ink cartridge 1 is attached thereto.

The ink cartridge 1 includes the casing 1*a*, the lid 1*b*, and a cap 1*e*. The casing 1*a* has a bottom wall 1*c* and a side wall 1*i* that partially define the ink chamber 16, and is open at an upper side. The lid 1*b* covers the upper open side of the casing 1*a*, and the cap 1*e* caps the bottom wall 1*c* of the casing 1*a*. The ink cartridge 1 is formed by fusing and bonding the lid 1*b* and the cap 1*e* to the casing 1*a*. Through the cap 1*e* are formed two exposing holes 1*f*, 1*g* through which valve devices 23, 24 (described later) are respectively exposed.

On a lower side of the bottom wall 1*c*, there are formed an ink communication chamber 30 and an air communication chamber 50. The ink in the ink chamber 16 is supplied to the exterior through the ink communication chamber 30, and the atmospheric air is introduced into the ink chamber 16 through the air communication chamber 50. The communication chambers 30, 50 are respectively partially defined inside tubular wall portions 1*h*, 1*k* that extend from the lower surface of the bottom wall 1*c*.

In the bottom wall 1*c* are formed an ink inlet port 1*d* for communication between the ink communication chamber 30 and the ink chamber 16, and an air introducing port 1*j* for communication between the air communication chamber 50 and the ink chamber 16. The air introducing port 1*j* has an internal diameter substantially the same as that of the air communication chamber 50. On an upper surface of the bottom wall 1*c* at a position corresponding to the air introducing port 1*j*, a tubular member 62 extends in the ink chamber 16.

Inside the tubular member 62 is defined an internal passage having a first portion 62*a* and a second portion 62*b*. The first portion 62*a* of the internal passage extends from the air introducing port 1*j* in a direction into the ink chamber 16 and gradually narrows in this direction in cross-sectional view, and the second portion 62*b* extends substantially straight from the first portion 62*a* further into the ink chamber 16. The air communication chamber 50 is open in the ink chamber 16 over an ink surface via the first and second portions 62*a*, 62*b* of the internal passage.

A plurality of ribs 70 are formed continuously from an inner surface of the first portion 62*a* of the internal passage to an upper portion of the air communication chamber 50 that is contiguous with the internal passage, such that each rib 70 extends toward a guide bar 66 of a valve member 65 described later. The number of the ribs 70 is three or more. A distance T1 between a lower end surface 70*a* of each rib 70 and an engaging portion 73 of a biasing member 63 (described later) is determined such that when the ink cartridge 1 is attached to the inkjet recording apparatus 2 as shown in FIG. 3, the engaging portion 73 is spaced from the lower end surface 70*a* of the rib 70 with a clearance smaller than the distance T1 therebetween.

On an inner surface of the ink communication chamber 30, there is formed a predetermined number of ribs 71 extending from a lower surface of the bottom wall 1*c* toward an engaging portion 37 of a biasing member 46 and accommodated in the ink communication chamber 30 as described later. The number of the ribs 71 is three or more. A distance T2 between a lower end surface 71*a* of each of the ribs 71 and the engaging portion 37 is determined such that when the ink cartridge 1 is attached to the inkjet recording apparatus 2 as shown in FIG. 3, the engaging portion 37 is spaced from the lower end surface 71*a* of the rib 71 with a clearance smaller than the distance T2 therebetween.

Valve devices 23, 24 are disposed in the ink and air communication chambers 30, 50, respectively. Hereinafter, the side associated with the ink communication chamber 30 may be referred to as "the ink supply side", while the side associated with the air communication chamber 50 may be referred to as "the air introduction side". The valve device 23 on the ink supply side includes the biasing member 46 integrally formed of elastic material, and a valve member 54 of resin. An outer shape of the biasing member 46 is substantially cylindrical. The biasing member 46 includes a valve seat portion 46*a*, a biasing portion 46*b* on a side of the valve seat portion 46*a* near the ink chamber 16, and an attaching portion 33 around the valve seat portion 46*a*, that 46*a*, 46*b*, 33 are integrally formed. The valve member 54 is accommodated in a valve chamber defined inside the biasing portion 46*b* and biased by the biasing portion 46*b* in a direction to be held in contact with the valve seat portion 46*a*.

An outer diameter of the attaching portion 33 is larger than that of the biasing portion 46*b*. The ink communication chamber 30 has an enlarged portion 44 where the diameter of the ink communication chamber 30 is larger than the other part. The attaching portion 33 is fitted in this enlarged portion 44. The biasing member 46 is fixed in position with the attaching portion 33 held between the inner surface of the ink communication chamber 30 and the cap 1*e*.

The valve seat portion 46*a* has a through-hole formed at a center thereof. The through-hole includes an upper portion 41, an insertion portion 35 under the upper portion 41, and a tapered guide passage 40 under the insertion portion 35. The insertion portion 35 is formed in a size to allow fitting insertion of the ink inlet tube 12 when the ink cartridge 1 is attached to the mounting portion 3.

The biasing portion 46*b* includes a cylindrical side wall portion 36 standing from a circumference of the valve seat portion 46*a* toward the ink chamber 16, and the engaging portion 37 extending from the side wall portion 36 inward, namely, to a side of the valve member 54 near the ink chamber 16. The engaging portion 37 has at its center an opening 37*a*, whose diameter d1 is smaller than a diameter d2 (shown in FIG. 4C) of a protrusion 57*a* (described later) of the valve member 54.

The biasing portion 46*b* biases the valve member 54 toward the valve seat portion 46*a*, by an elastic force of the side wall portion 36 and the engaging portion 37. Normally, the valve member 54 is held in close contact with the valve seat portion 46*a*. When the ink inlet tube 12 is inserted into the insertion portion 35, the ink inlet tube 12 pushes the valve member 54 toward the ink chamber 16, and the pushed valve member 54 in turn pushes the engaging portion 37 upward with the side wall portion 36 stretched, thereby forming a clearance between a lower surface of the valve member 54 and the valve seat portion 46*a* so as to allow passage of the ink.

According to the present embodiment where the biasing member 46, 63 is integrally formed to include the valve seat portion 46*a*, 63*a*, the side wall portion 36, 72, and the engaging portion 37, 73, the number of components can be reduced, thereby enabling to simplify a production process of the ink cartridge 1. Further, since the valve seat portion 46*a*, 63*a* is formed of an elastic material, sealability between the valve seat portion 46*a*, 63*a* and the valve member 54, 65 (68) is improved, thereby making it possible to reliably shut off communication between the ink chamber 16 and the exterior of the ink cartridge 1 when the valve member 54, 65 (68) is in contact with the valve seat portion 46*a*, 63*a*.

As shown in FIGS. 4A-4D, the valve member 54 includes a bottom portion 57, a cylindrical side wall portion 56 extending perpendicularly upward from a circumference of the bottom portion 57, and a communication passage 58 continuously formed from the bottom portion 57 to the side wall portion 56. The bottom portion 57 has the protrusion 57*a*, which is annular, at a side thereof opposed to the valve seat portion 46*a*. The protrusion 57*a* is formed radially inside of the communication passage 58, but on an outer side of an open end of the upper portion 41 or the through-hole formed in the valve seat portion 46*a*. With the valve member 54 pressed by the biasing portion 46*b* onto the valve seat portion 46*a*, the protrusion 57*a* of the valve member 54 elastically deforms and closely contacts an upper surface of the valve seat portion 46*a*. The diameter d2 (shown in FIG. 4C) of the protrusion 57*a* is larger than the diameter d1 (shown in FIG. 2) of the opening 37*a* formed at the center of the engaging portion 37.

Similarly to the valve device 23 on the ink supply side, the valve device 24 on the air introduction side includes a biasing member 63 integrally formed of an elastic member, and a valve member 65 of resin. The biasing member 63 is similar to the biasing member 46 of the ink supply side, that is, the biasing member 63 includes a valve seat portion 63*a*, a biasing portion 63*b*, an attaching portion 63*e*, that are integrally formed. The biasing portion 63*b* is similar to the biasing portion 46*b* of the ink supply side, and includes a cylindrical side wall portion 72 standing upright from a circumference of the valve seat portion 63*a* toward the ink chamber 16, and the engaging portion 73 extending from the side wall portion 72 inward, namely, to a side of the valve member 65 near the ink chamber 16. The engaging portion 73 has at its center an opening 74, whose diameter d3 (shown in FIG. 2) is smaller than a diameter d4 (shown in FIG. 5C) of a protrusion 157*a* (described later) of the valve member 65. The functions of the respective parts of the biasing member 63 are the same as those of the biasing member 46 at the ink supply side, and description thereof is dispensed with.

The valve seat portion 63*a* has a through-hole 63*c*, through which an operating portion 67 (described later) of the valve member 65 is inserted. Under the valve seat portion 63*a*, a cylindrical sealing portion 63*d* is integrally formed to around an open end of the through-hole 63*c*.

Figure 5A:
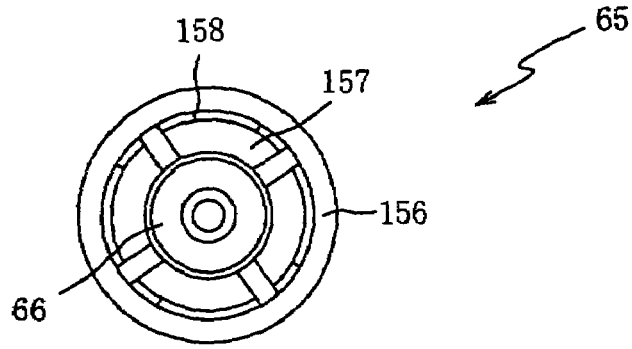
FIGS. 5A, 5B and 5C are a plan view, a side view, and a bottom view, of another valve member of the ink cartridge.
Figure 5B:
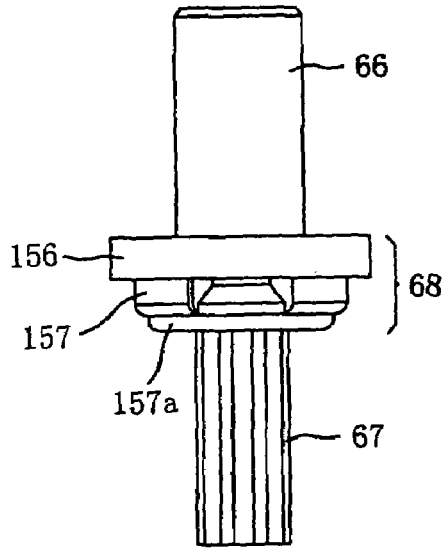
Figure 5C:
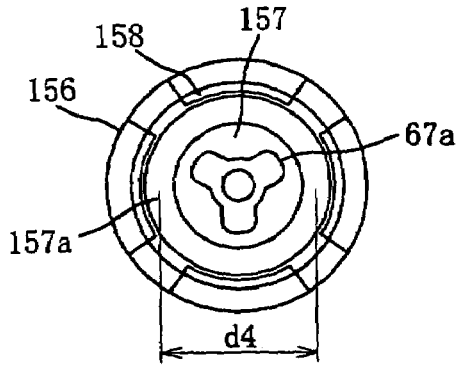

As shown in FIGS. 5A-5C, the valve member 65 includes a guide bar 66 at its upper side, the operating portion 67 at its lower side, and a valve portion 68 substantially at its middle portion. Similarly to the valve member 54 shown in FIGS. 4A-4D, the valve portion 68 includes a bottom portion 157, a side wall portion 156, a communication passage 158, and a protrusion 157*a* on a lower surface of the bottom portion 157. The valve portion 68 is similar in structure as the valve member 54, and the parts or elements corresponding to those of the valve member 54 will be denoted by the same reference numerals and description thereof is omitted. That is, at the air introduction side, the valve portion of the valve member 65 corresponds to a valve member as defined in the appended claims.

The guide bar 66 is cylindrical and stands upright from the bottom portion 157. The guide bar 66 is inserted through the opening 74 of the biasing portion 63*b* with a clearance between the guide bar 66 and an inner circumferential surface of the opening 74, such that the guide bar 66 is located at a position to be surrounded by the ribs 70.

The operating portion 67 is a part vertically or downward extending from the bottom portion 157, through the through-hole 63*c* formed in the valve seat portion 63*a* with a clearance between an inner circumferential surface of the through-hole 63*c* and the operating portion 67 to allow passage of the air.

In the mounting portion 3 at which the ink cartridge 1 is attached, the ink inlet tube 12 protrudes on the ink supply side, and an elastic porous material 3*c* such as sponge material is embedded around a lower base portion of the ink inlet tube 12. The elastic porous material 3*c* is disposed there to absorb ink leaking from the ink cartridge 1, although such ink leakage is to be prevented by the arrangement according to the present invention. That is, the elastic porous material 3*c* is disposed to provide for some extreme situations.

A communication opening 12*a* in the form of a cutout is formed at an upper end of the ink inlet tube 12 so as to communicate, in a radial direction of the ink inlet tube 12, an internal passage formed inside the ink inlet tube 12 and a space around the ink inlet tube 12. When the ink inlet tube 12 is brought into contact with the valve member 54, the communication opening 12*a* ensures communication between the internal passage defined in the ink inlet tube 12 and the ink chamber 16.

At the air introduction side of the mounting portion 3, a recess 3*d* is formed at a position corresponding to the sealing portion 63*d* of the biasing member 63 of the ink cartridge 1. In the recess 3*d*, the air supply passage 13 is open at a position not to be completely covered by a lower end of the operating portion 67. When the ink cartridge 1 is attached on the mounting portion 3 as shown in FIG. 3, the sealing portion 63*d* is fitted in the recess 3*d* with an end portion of the sealing portion 63*d* elastically deformed to be held in close contact with a bottom of the recess 3*d*, thereby establishing sealed communication between the air supply passage 13 and the air introducing port 1*j*.

Referring to FIGS. 2 and 3, there will be described a state when the ink cartridge 1 is attached to the mounting portion 3. Before the ink cartridge 1 is attached to the mounting portion 3, as shown in FIG. 2, at the air introduction side the operating portion 67 protrudes downward from the cap 1*e* with a lower end of the operating portion 67 located slightly above an extreme lower end of the sealing portion 63*d*, and the valve member 65 is biased by the biasing portion 63*b* to be held in close contact with the valve seat portion 63*a*. Meanwhile, at the ink supply side the valve member 54 is biased by the biasing portion 46*b* to be held in close contact with the valve seat portion 46*a*.

When the ink cartridge 1 is attached on the mounting portion 3 as shown in FIG. 3, at the ink supply side an upper end of the ink inlet tube 12 pushes the valve member 54 upward, thereby stretching the side wall portion 36 of the biasing portion 46*b* so that the valve member 54 separates away from the valve seat portion 46*a*, placing the valve device 23 in an open state where the valve member 54 is at a first position to permit communication between the ink chamber 16 and the exterior of the ink cartridge. Hence, the ink stored in the ink chamber 16 is supplied into the ink inlet tube 12 via the ink inlet port 1*d*, the ink communication chamber 30, the opening 37*a* formed in the engaging portion 37, the communication passage 58 (shown in FIGS. 4A-4D) in the valve member 54, and the communication opening 12*a* at the end of the ink inlet tube 12.

Meanwhile, at the air introduction side, in a state where an end of the operating portion 67 is held in contact with the bottom of the recess 3*d* to fix the valve member 65 in position, the valve seat portion 63*a* of the biasing member 63 is displaced downward relatively to the valve member 65, in other words, the valve member 65 is pushed upward relatively to the valve seat portion 63*a*, with the side wall portion 72 of the biasing portion 63*b* stretched so that the valve member 65 separates away from the valve seat portion 63*a*, thereby placing the valve device 24 in an open state where the valve member 65 is placed in a first position to communicate the inside of the ink cartridge with the exterior thereof. The guide bar 66 of the valve member 65 moves along vertically extending end surfaces of the ribs 70 which surfaces are opposite to an inner surface of the air introducing port 1*j*, such that even when a direction in which the valve member 65 is pushed deviates from an exactly vertical direction which is a normal direction in which the valve member 65 is expected to move by being pushed (hereinafter, the normal direction in which the valve member 65 is expected to be pushed may be referred to as "the normal direction in which the valve member 65 is expected to move"), the deviation is limited by the ribs 70 that make the valve member 65 move in a substantially vertical direction. That is, the vertically extending end surfaces of the ribs 70 correspond to a guiding portion. Thus, the side wall portion 72 is stretched substantially uniformly over an entire circumference thereof, thereby inhibiting the conventionally seen local stretch at the side wall portion which makes the valve member to tend to get out of the engaging portion, and enabling to have the valve member operate normally.

When the valve device 24 is placed in the open state, the ink chamber 16 is communicated with the space outside the recording apparatus 2, via the air supply passage 13, the clearance between the operating portion 67 and the through-hole 63*c*, the communication passage 158 (shown in FIGS. 5A-5C) in the valve member 65, the clearance between the guide bar 66 and an internal circumferential surface of the opening 74 in the engaging portion 73, the air communication chamber 50, a space between each adjacent two ribs 70 in the first portion 62*a* of the internal passage defined in the tubular member 62, and the second portion 62*b* of the internal passage.

Figure 6:
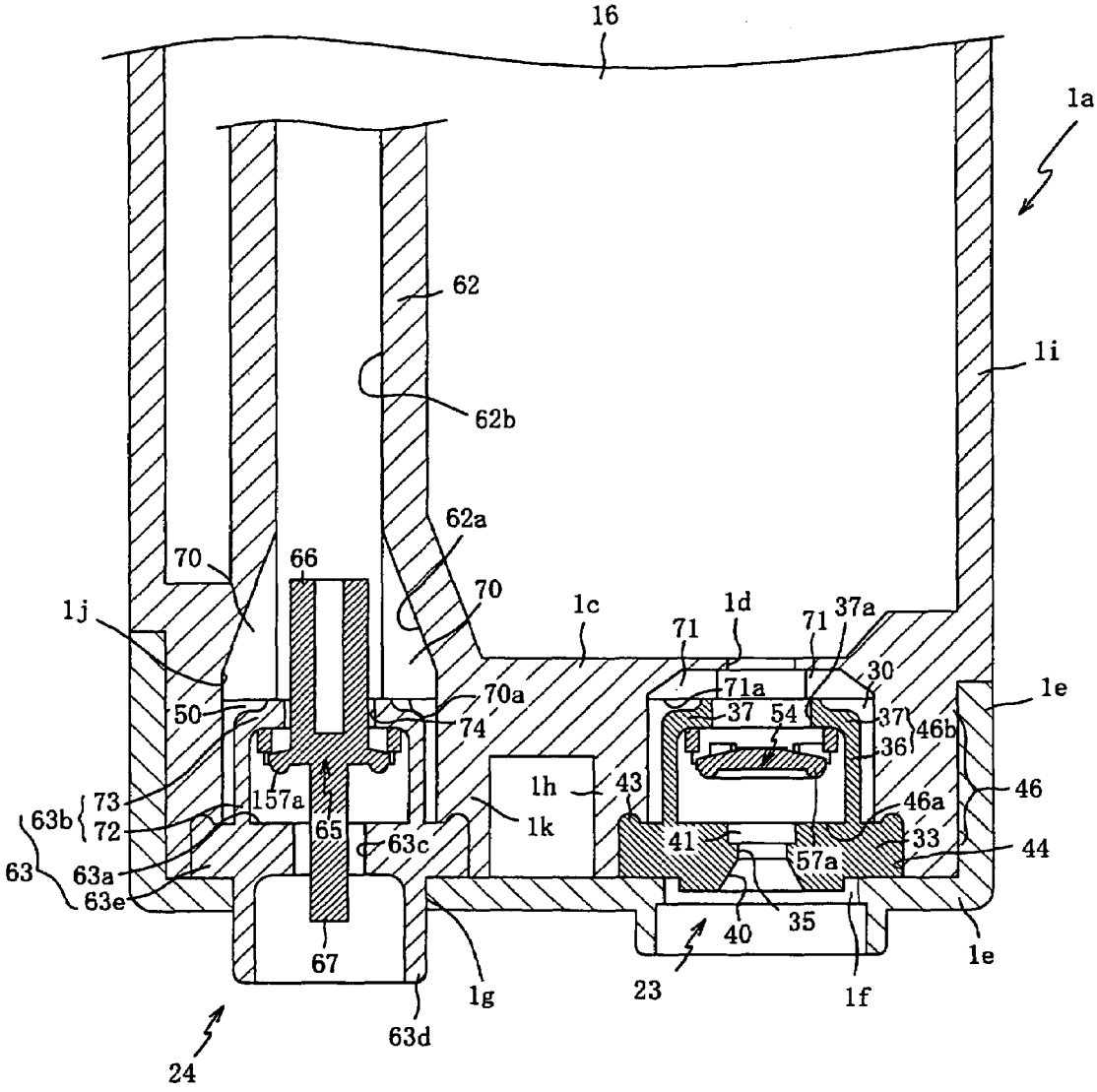
FIG. 6 is a cross-sectional view of the ink cartridge illustrating how valve devices including the valve members operate.

Referring next to FIG. 6, there will be described how each valve device 23, 24 operates when the valve member 54, 65 is pushed upward by an amount larger than a normal, expected amount, in a case where the ink cartridge 1 is improperly attached or where a user tampers with the ink cartridge 1, for instance.

The biasing members 46, 63 respectively supporting the valve members 54, 65 are formed of elastic material. Hence, when the valve member 54, 65 is pushed upward, the side wall portion 36, 72 is stretched to be longer, thereby making the engaging portion 37, 73 inclined to widen the opening 37, 73 of the engaging portion 37, 73. When the side wall portion 36, 72 is further stretched upward, the valve member 54, 65 makes the engaging portion 37, 73 greatly inclined to enlarge the opening 37*a*, 74 so that the valve member 54, 65 disengages from, or gets out of, the biasing member 46, 63 through the opening 37*a*, 74. The valve member 54, 65 once having gotten out of the biasing member 46, 63 in this way can not return to the position to be held in close contact with the valve seat portion 46*a*, 63*a*.

In the ink cartridge according to the present embodiment, the lower end surfaces 71*a*, 70*a* of the ribs 71, 70 function as a limiter for inhibiting each of the valve members 54, 65 from moving by an excessively large amount. That is, the distance T1, T2 between an upper surface of the engaging portion 37, 73 and the lower end surface 71*a*, 70*a* of the rib 71, 70 is determined such that before the opening 37*a*, 74 enlarges to a size larger than the valve member 54, 65 to allow the valve member 54, 65 to come out of the engaging portion 37, 73, the upper surface of the engaging portion 37, 73 is brought into contact with the lower end surface 71*a*, 70*a* of the rib 71, 70, as shown in FIG. 6.

Hence, even when the valve member 54, 65 is pushed upward by an amount beyond a normal, expected amount, the valve member 54, 65 does not disengage from the biasing member 46, 63, that is, does not get out of the biasing member 46, 63 through the opening 37*a*, 74, thereby preventing the valve device 23, 24 from being left in their open state which may be otherwise caused and lead to problems such as leakage of the ink to the exterior of the ink cartridge, and increase in the viscosity of the ink due to evaporation of water or other components from the ink.

According to the present ink cartridge, a limiter is constituted by a surface (namely, the lower end surface of each rib) with which the engaging portion is brought into contact before the valve member disengages from the engaging portion. That is, that surface can serve as a limiter by suitably determining the distance between the surface and the engaging portion, thereby enabling to simplify an internal structure of the ink cartridge.

It is noted that the place where ink leakage occurs is not limited to the valve device 23 on the ink supply side. That is, it may happen that the ink is introduced into the first and second portions 62*a*, 62*b* of the internal passage, for instance when a user falls the ink cartridge while carrying the ink cartridge, and thereafter the ink leaks from the valve device 24 upon placing the valve device 24 on the air introduction side in the open state. Similarly, components of the ink such as water may evaporate at the valve device 23 on the ink supply side.

When the valve member 54, 65 is pushed in an obliquely upward direction that is deviated from a normal, vertical direction in which the valve member 54, 65 is expected to move by being pushed, a part of the side wall portion 36, 72 is greatly stretched to accordingly deform the opening 37*a*, 74, making the valve member 54, 65 prone to get out of the biasing member 46, 63 through the opening 37*a*, 74. At the valve member 24 on the air introduction side, the guide bar 66 slides on the ribs 70 and is thus guided in a substantially vertical direction, as described above. Hence, it does not occur that only a part of the side wall portion 72 is greatly stretched, and thus the possibility of the disengagement of the valve member 65 from the biasing member 63 through the opening 74 is reduced. In this embodiment, since the air communication chamber has an internal passage communicating with the ink chamber, at a position to allow the valve member to enter the internal passage when the valve member is pushed upward, and a guiding portion constituted by the ribs extending from the inner surface of the internal passage toward the guide bar cooperates with the guide bar to constitute a guide device, a fluid passage is formed between the inner surface of the internal passage and the guide bar, and the guide bar can be properly guided along the ribs.

In the present embodiment, this guiding of the valve member 65 to prevent local great stretch of the engaging portion 73 is implemented at the valve device 24 on the air introduction side, but a guide bar may be employed in the valve device 23 on the ink supply side, too, so as to have the valve member 54 guided by the ink inlet port 1*d* or the ribs 71.

According to this embodiment, even where the valve member 54, 65 disengages from the biasing member 46, 63 through the opening 37*a*, 74 when pushed abruptly since the biasing member 46, 63 has a dimension smaller than a nominal dimension because of a manufacturing error or for other reasons, or since the side wall portion 36, 72 does not sufficiently stretch accordingly to pushing of the valve member 54, 65, it is prevented that the valve device 23, 24 of the ink cartridge is kept in the open state, for the following reason.

Figure 7:
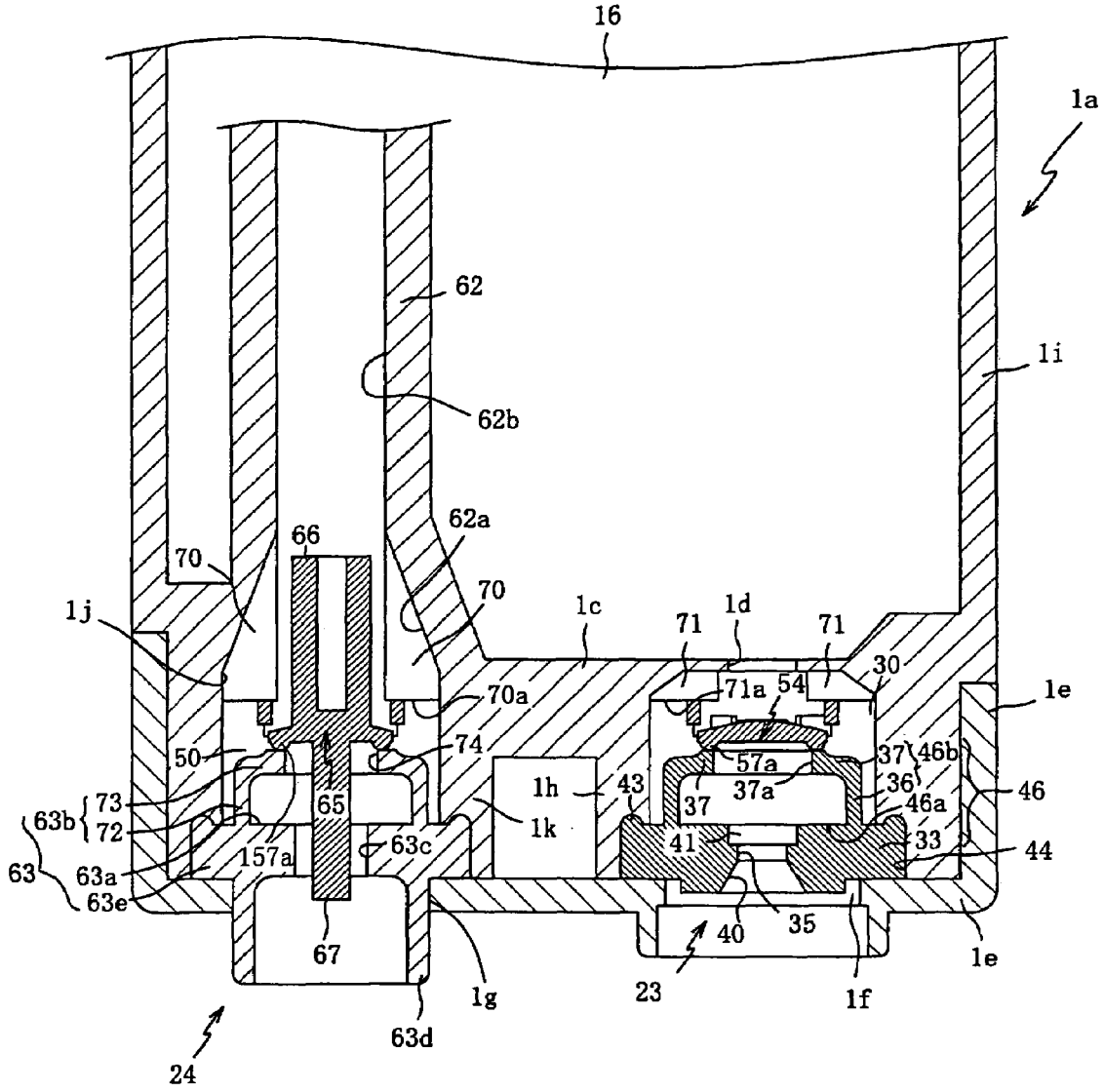
FIG. 7 is another cross-sectional view of the ink cartridge illustrating how the valve devices operate.

That is, as described above, the diameter d2, d4 of the protrusion 57*a*, 157*a* of the valve member 54, 65 is larger than the diameter d1, d3 (shown in FIG. 2) of the opening 37*a*, 74, and the distance T1, T2 (shown in FIG. 2) is substantially equal to or slightly smaller than a height or thickness of the valve member 54, 65 in a direction parallel to the direction in which the valve member 54, 65 moves, i.e., a dimension from a lower end of the protrusion 57*a*, 157*a* to a lower surface of the engaging portion 37, 73 when not stretched. Hence, when the valve member 54, 65 disengages from the biasing member 46, 63 or gets out through the opening 37*a*, 74, as shown in FIG. 7, the side wall portion 36, 72 contracts such that the engaging portion 37, 73 changes its shape along a lower surface of the valve member 54, 65 back to its original shape. Consequently, the valve member 54, 65 is sandwiched between the upper surface of the engaging portion 37, 73 and the lower end surface 71*a*, 70*a* of each rib 71, 70, so that the lower surface of the valve member 54, 65 closes the opening 37*a*, 74. Thus, in the event of the disengagement of the valve member 54, 65 from the biasing member 46, 63 through the opening 37*a*, 74, the valve device 23, 24 is prevented from being left in the open state. In the conventional arrangement, on the other hand, the valve device 23, 24 can not be restored from this open state to a closed state where the valve member 54, 65 is placed in a second position to shut off the communication between the ink chamber and the exterior of the cartridge. Thus, according to the present embodiment, the problems due to the valve device 23, 24 left in the open state, such as ink leakage, are prevented.

According to the first embodiment, a guiding portion of a guide device and a limiter are constituted by the same element, namely, the ribs. Hence, the number of components of the ink cartridge can be reduced.

Figure 8:
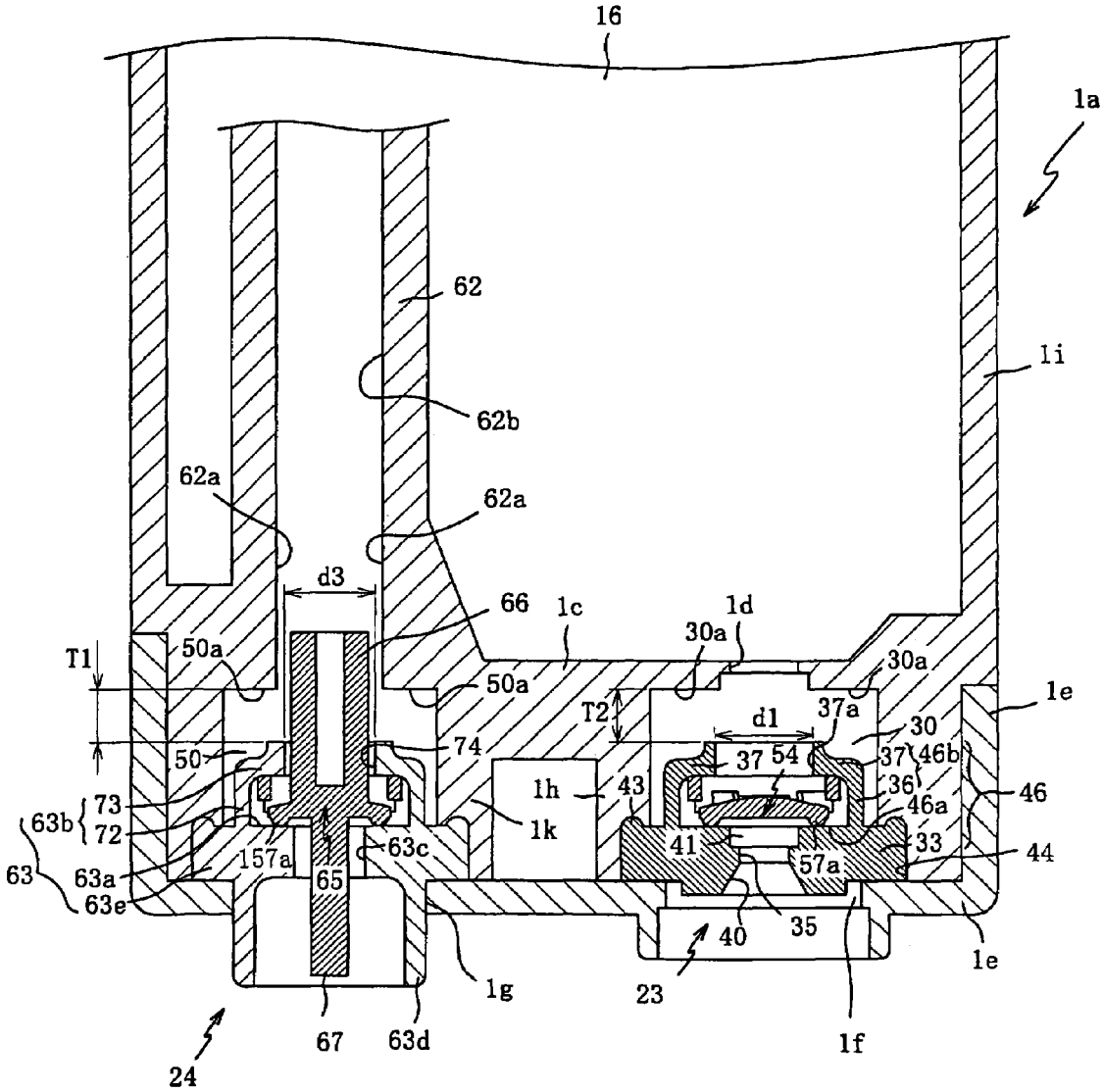
FIG. 8 is a fragmentary cross-sectional view of an ink cartridge according to a second embodiment.

Referring next to FIG. 8, there will be described an ink cartridge according to a second embodiment of the invention. The parts and elements corresponding to those of the first embodiment are denoted by the same reference numerals and description thereof is omitted.

In the first embodiment, the ribs 70, 71 limit the displacement of the valve member 65, 54. However, according to the second embodiment, in place of the ribs 70 on the air introduction side and the ribs 71 on the ink supply side, engaging portions 73, 37 are brought into abutting contact with a ceiling surface 50*a* of the air communication chamber 50 and a ceiling surface 30*a* of the ink communication chamber 30, respectively, to limit the displacement of the valve members 65, 54, as shown in FIG. 8.

As shown in FIG. 8, an inner surface of a first portion 62*a* of an internal passage is cylindrical and spaced from an outer circumferential surface of a guide bar 66 by a small distance, so that the guide bar 66 is guidable along the inner surface of the first portion 62*a* of the internal passage in sliding contact therewith.

According to the second embodiment, since the air communication chamber has an internal passage communicating with the ink chamber, at a position to allow the valve member to enter in the internal passage when the valve member is pushed upward, the valve member, and a guiding portion constituted by the inner surface of the internal passage cooperates with the guide bar to constitute a guide device, an internal structure of the ink cartridge is simplified.

According to the ink cartridge of the second embodiment, a limiter is constituted by a surface (namely, the ceiling surface of the air communication chamber and the ink communication chamber) with which the engaging portion is brought into contact before the valve member disengages from the engaging portion. That is, that surface can serve as a limiter by suitably determining the distance between the surface and the engaging portion, thereby enabling to simplify an internal structure of the ink cartridge.

Figure 9:
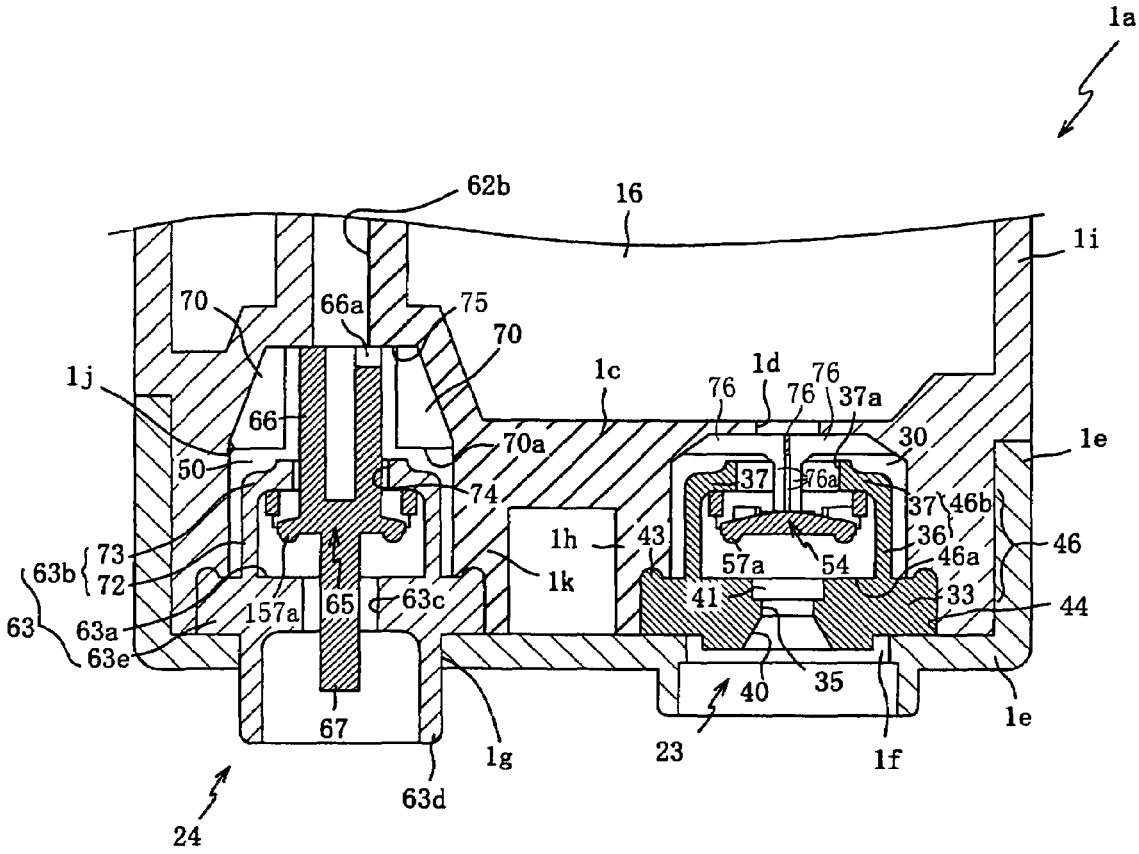
FIG. 9 is a fragmentary cross-sectional view of an ink cartridge according to a third embodiment.

Referring to FIG. 9, there will be described an ink cartridge according to a third embodiment of the invention. The parts and elements corresponding to those in the first embodiment will be denoted by the same reference numerals and description thereof is omitted.

As shown in FIG. 9, a plurality of ribs 76, each having a downward protruding portion 76*a*, extend from a ceiling surface of an ink communication chamber 30 to meet at a substantially central portion, in plan view, of the ink communication chamber 30. The protruding portions 76*a* cooperate to constitute a protrusion whose lower end surface is directly opposed to the valve member 54 through an opening 37*a* formed in an engaging portion 37, so that when the valve member 54 is lifted, the protrusion made up of the protruding portions of the ribs 76 enters the opening 37*a* of the engaging portion 37 to directly contact the valve member 54 so as to prevent an excessive displacement of the valve member 54. It is noted that a horizontally extending part of the group of the ribs 76 corresponds to a bridge, and the protrusion made up of the protruding portions 76*a* of the ribs 76 corresponds to a direct contact portion.

An upper end of a guide bar 66 of a valve member 65 is directly brought into contact with a ceiling surface of an air communication chamber 50, so as to prevent an excessive movement of the valve member 65. One of the ceiling surface 75 and the guide bar 66 has a communication passage 66*a* which allows air communication while the guide bar 66 is in contact with the ceiling surface 75.

According to the ink cartridge of the third embodiment, a limiter is constituted by a surface (namely, the ceiling surface 75, and the lower end surface of the protrusion made up of the protruding portions 76*a* of the ribs 76) with which the valve member is directly brought into contact before the valve member disengages from the engaging portion. That is, that surface can serve as a limiter by suitably determining the distance between the surface and the engaging portion, thereby enabling to simplify an internal structure of the ink cartridge.

In each of the above-described embodiments, the opening 37*a*, 74 are formed in the biasing members 46, 63 to open in the direction of the displacement of the valve members 54, 65 so as to permit communication of the ink and the air. However, a position at which the opening 37*a*, 74 is formed in the biasing member 46, 63 is not limited to this. For instance, as long as communication between the valve chamber accommodating the valve member 54, 65 and the ink or air communication chamber 30, 50 can be established, the opening 37*a*, 74 may be formed in the side wall portion 36, 72 of the biasing member 46, 63. When the opening 37*a*, 74 is formed in the side wall portion 36, 72, the communication passage 58, 158 of the valve member 54, 65 can be omitted.

Each of the embodiments may be modified such that the air supply passage 13 in the mounting portion takes the same form as the ink inlet tube 12, namely, a tubular form extending upward from the mounting portion, and the valve device 24 on the air introduction side has the same structure as the valve device 23 on the ink supply side. Alternately, each embodiment may be modified such that the ink supply tube 12 does not protrude from the mounting portion and the valve device 23 on the ink supply side has the same structure as the valve device 24 on the air introduction side.

Although several embodiments of the present invention have been described above, it is to be understood that the invention is not limited to the details of the embodiments, but may be otherwise embodied with various changes and modifications which may occur to those skilled in the art without departing from the spirit and scope of the invention as defined in the appended claims.

What is claimed is:

1. An ink cartridge comprising:

an ink chamber storing ink;

a valve seat having a valve hole;

a communication chamber communicating the ink chamber with the exterior of the ink cartridge via the valve hole;

a valve member disposed in the communication chamber such that the valve member is displaceable between a first position to separate away from the valve seat to allow communication between the ink chamber and the exterior via the valve hole, and a second position to be held in close contact with the valve seat to shut off the communication;

a biasing member including (a) side wall portion surrounding the valve member, and (b) an engaging portion extending inward from an end of the side wall portion and engaging with the valve member;

the biasing member normally holding the valve member at the second position but allowing the valve member to be placed at the first position by an elastic deformation of at least one of the side wall portion and the engaging portion, and generating a biasing force to restore the valve member to the second position; and a disengagement preventer which prevents the valve member from disengaging from the engaging portion when the valve member is abnormally operated toward the first position.

2. The ink cartridge according to claim 1, wherein the disengagement preventer includes at least one of a limiter which limits the displacement of the valve member before the valve member disengages from the engaging portion, and an inclination restrictor which restricts inclination of the valve member with respect to a normal direction in which the valve member is expected to move by being pushed.

3. The ink cartridge according to claim 2, wherein the disengagement preventer includes the limiter, and the limiter includes an indirect contact portion which is brought into contact with the valve member via the biasing member so as to inhibit the valve member from being displaced to such an amount that the valve member is disengaged from the engaging portion.

4. The ink cartridge according to claim 3, further comprising a cylindrical wall which defines the communication chamber inside thereof and includes a shoulder surface extending in a direction intersecting with the normal direction in which the valve member is expected to move, the shoulder surface constituting the indirect contact portion.

5. The ink cartridge according to claim 3, further comprising a cylindrical wall which defines the communication chamber inside thereof, and a plurality of ribs extending from an inner surface of the cylindrical wall into the communication chamber, each of the ribs having a lower end surface extending in a direction intersecting with a direction of the displacement of the valve member, and the lower end surfaces of the ribs constituting the indirect contact portion.

6. The ink cartridge according to claim 3, wherein:

the biasing member further comprises a valve chamber defined by (a) a valve seat portion as the valve seat; (b) the engaging portion having an opening having a diameter smaller than that of the valve member; and (c) the side wall portion, the valve chamber accommodating the valve member and being communicated with the exterior of the valve chamber only at the valve hole and the opening; and a distance between the engaging portion and the indirect contact portion in the normal direction when a force is not imposed on the biasing member is smaller than a dimension of the valve member in the normal direction.

7. The ink cartridge according to claim 2, wherein the disengagement preventer includes the limiter, and the limiter includes a direct contact portion which is brought into direct contact with the valve member so as to inhibit the valve member from being displaced to such an amount that the valve member is disengaged from the engaging portion.

8. The ink cartridge according to claim 7, further comprising a cylindrical wall which defines the communication chamber inside thereof, and a bridge extending across opposing portions of an inner surface of the cylindrical wall, the direct contact portion extending from a middle portion of the bridge in a direction parallel to the normal direction.

9. The ink cartridge according to claim 2, wherein the disengagement preventer includes the inclination restrictor, and the inclination restrictor includes a guide device including (a) a guide bar extending from the valve member in a direction parallel to the normal direction in which the valve member is expected to move, and (b) a guiding portion which engages the guide bar in sliding contact to guide the guide bar in a direction parallel to the normal direction.

10. The ink cartridge according to claim 9, further comprising a cylindrical wall which defines the communication chamber inside thereof, and at least three ribs each extending from an inner surface of the cylindrical wall into the communication chamber, an end surface of each of the ribs which surface is opposite to the cylindrical wall engaging the guide bar in sliding contact, and functioning as the guiding portion.

11. The ink cartridge according to claim 10, wherein end surfaces of the ribs, which surfaces are opposed to the valve member, are brought into contact with the valve member via the biasing member so as to inhibit the valve member from being displaced to such an amount that the valve member disengages from the engaging portion, the end surfaces thus functioning as the limiter.

12. The ink cartridge according to claim 9, further comprising a cylindrical wall which defines inside thereof the communication chamber and an internal passage communicated with the communication chamber, an inner surface of the internal passage engaging with the guide bar in sliding contact, and thus functioning as the guiding portion.

13. The ink cartridge according to claim 12, further comprising a shoulder surface extending at a boundary between the communication chamber and the internal passage, in a direction intersecting with the normal direction, the valve member being brought into contact with the shoulder surface via the biasing member so that the valve member is inhibited from being displaced to such an amount that the valve member disengages from the engaging portion, and thus the shoulder surface functioning as the limiter.

14. The ink cartridge according to claim 9, further comprising a cylindrical wall which defines inside thereof the communication chamber, the cylindrical wall having a contact surface which extends in a direction intersecting with the normal direction and is brought into contact with the guide bar so as to inhibit the valve member from being displaced to such an amount that the valve member disengages from the engaging portion, and the contact surface thus functioning as the limiter.

15. The ink cartridge according to claim 1, wherein the side wall portion includes a hollow cylindrical portion surrounding an outer circumference of the valve member, and the engaging portion includes a flange extending inward from an end of the hollow cylindrical portion.

16. The ink cartridge according to claim 1, wherein the biasing member has at a center thereof a valve hole, and is integrally formed of rubber or a like material to include the side wall portion, the engaging portion, and a valve seat portion having a valve surface around the valve hole, with which valve surface the valve member is held in contact.

17. The ink cartridge according to claim 1, wherein the biasing member further comprises a valve chamber defined by (a) a valve seat portion as the valve seat; (b) the engaging portion having an opening having a diameter smaller than that of the valve member; and (c) the side wall portion, the valve chamber being communicated with the exterior of the valve chamber only at the valve hole and the opening.

18. The ink cartridge according to claim 17, wherein at least one of the biasing member and the valve member has a communication passage for communicating a space inside the biasing member with the opening while the engaging portion and the valve member are in engagement.

19. The ink cartridge according to claim 1, wherein the biasing member allows the valve member to be placed at the first position by an elastic deformation of at least the side wall portion.

20. The ink cartridge according to claim 19, wherein the elastic deformation includes stretch of the side wall.

* * * * *